United States Patent [19]

Ishikawa et al.

[11] Patent Number: 4,735,523

[45] Date of Patent: Apr. 5, 1988

[54] VIBRATORY COMPACTION WORKING MACHINE

[75] Inventors: Yasuaki Ishikawa, Ibaraki; Hirokazu Miyagawa, Tsuchiura; Shiro Murakami, Ibaraki; Hiroshi Koma, Tsuchiura; Yutaka Ikeda, Nabari; Yoshifumi Itou, Matsubara, all of Japan

[73] Assignee: Hitachi Construction Machinery Co., Ltd., Tokyo, Japan

[21] Appl. No.: 878,258

[22] Filed: Jun. 25, 1986

[30] Foreign Application Priority Data

Oct. 29, 1985 [JP] Japan ..... 60-165090[U]
Oct. 29, 1985 [JP] Japan ..... 60-165091[U]

[51] Int. Cl.[4] ..... E01C 19/34
[52] U.S. Cl. ..... 404/133; 212/268
[58] Field of Search ..... 404/133; 212/268, 264, 212/207

[56] References Cited

U.S. PATENT DOCUMENTS 3,419,157 12/1968 Brady ..... 212/268
3,809,250 5/1974 Pilch ..... 212/264
3,908,292 9/1975 Harris ..... 404/133
3,930,741 1/1976 Berry ..... 404/133

FOREIGN PATENT DOCUMENTS 2855805 6/1979 Fed. Rep. of Germany ..... 404/133

*Primary Examiner*—Stephen J. Novosad
*Assistant Examiner*—William P. Neuder
*Attorney, Agent, or Firm*—Antonelli, Terry & Wands

[57] ABSTRACT

A vibratory compaction working machine has a lower travel structure and an upper swing structure mounted on the lower travel structure. The upper swing structure has a boom mounted thereon for pivotal movement by a first hydraulic cylinder, an arm mounted on the boom at its forward end for pivotal movement by a second hydraulic cylinder, and vibratory plate compactor mounted on the arm at its forward end for pivotal movement by a third hydraulic cylinder. The arm is in the form of an extension arm having a first arm element and a second arm element mounted for linear movement relative to the first arm element by a fourth hydraulic cylinder. The first arm element is attached at the forward end of the boom for pivotal movement by the second hydraulic cylinder, and the second arm element has the vibratory plate compactor attached to the forward end thereof for pivotal movement by the third hydraulic cylinder.

11 Claims, 11 Drawing Sheets

VIBRATORY COMPACTION WORKING MACHINE

BACKGROUND OF THE INVENTION

The present invention relates to a vibratory compaction working machine to be used for compacting backfilling soil of an excavated ditch formed below the ground surface level, and more particularly, to a machine for compacting soil placed around and above pipes for water supply and drainage, waste water, electric cables, city gas, etc. which have been laid on the bottom of the excavated ditch.

A vibratory compaction working machine of the aforementioned type have been proposed which employs a hydraulic excavator as base machine. More particularly, as shown in FIG. 1. The machine indludes a lower travel structure 1 on which an upper swing structure 2 is mounted, with the upper swing structure having a boom 3 mounted thereon for pivotal movement about a pin 5 by a hydraulic boom cylinder 4, and an arm 6 mounted on the forward end of the boom 3 for pivotal movement about a further pin 8 by a hydraulic arm cylinder 7. When it is desired to use the machine as a usual hydraulic excavator, the upper structure is further provided with an excavating bucket mounted on the forward end of the arm 6 for pivotal movement, while when it is desired to use it as a compaction working machine, a vibratory plate compactor 11 is mounted by a pin 9 applied through the fixing holes for bucket. This vibratory plate compactor 11 comprises a support bracket 13 connected via the above pin 9 to the arm 6 and connected through a further pin 10 to links 33 connected to a hydraulic bucket cylinder 12, a vibrating unit 14 attached to the bracket 13 through vibration damping and force transmitting rubber members 15, and a compacting plate 16 attached underneath the vibrating unit 14. As shown in FIG. 2, the vibratory unit 14 includes a hydraulic motor **14*a* and a pair of eccentric weights 14*b* to be driven by the motor 14*a***.

The vibratory compaction working machine of the conventional design as constructed above is operated as follows.

Suppose that a concrete pipe 18 of a relatively large diameter (e.g. 1 to 5 m) is laid on the bottom of a ditch 17 defined below the ground surface level (See FIG. 1), as shown in FIG. 3, a distributor 30 with a double chute 34 is operated to distribute soil 19 over at both sides of the pipe 18. Then, the boom cylinder 4, arm cylinder 7 and bucket cylinder 12 of the working machine are actuated to carry out a compaction by the compacting plate 16 of the vibratory plate compactor 11 to form a compacted soil zone of a unit thickness t measured from the bottom of the excavated ditch 17 (this unit thickness t is to be determined according to the compacting strength provided by the machine) and of a width corresponding to the width W of the compacting plate 16 (See FIG. 2B). Subsequently, the vibratory plate compactor 11 is slightly raised and the machine body (the lower travel structure and upper swing structure) is shifted a distance corresponding to the width W. The same stem of compaction is effected once again to form a further compacted soil zone with a width of W and a thickness of t, so that backfilling and compaction of a layer A is eventually performed. In this manner, similar operations are repeated for a number of layers B, C, D . . . in sequence until the combined thickness of those layers completely cover the top of the concrete pipe 18.

In this operation, there is a risk of the bucket cylinder 12 or the vibratory plate compactor 11 striking against the concrete pipe 18 when a first compaction of the layer A shown in FIG. 1 by the width W of the compacting plate 16 is completed and the vibratory plate compactor 11 is slightly raised from the layer A by slightly lifting the boom 3 by extending the boom cylinder 4. In order to avoid the risk, it will be necessary that, while the boom 3 is raised as in the direction of an arrow a in FIG. 1 by extending the boom cylinder 4, the arm 6 is pivotally moved in a direction of the arrow b by extending the arm cylinder 7. Also after the machine body is shifted a distance corresponding to the unit width w, and when the plate compactor 11 is lowered to set in a second compacting position, it will be necessary to set the plate compactor 11 in an initial position while avoiding engagement with the ditch 17 or pipe 18 by the reverse combined operation of retracting the boom cylinder 4 and the arm cylinder 7. This operation in fact is very complicated for the operator. This complicated combined operation is also necessary when the plate compactor 11 is lowered in response to or following a reduction of the soil thickness 19 or sinking of the soil that may result from the weight of the upper swing structure 2 applied to the plate compactor 11 as a downwardly-directed working forces during the compacting operation. It is noted that the unit thickness t after the sinking of each layer is several tens % less than the original thickness before compaction.

There may be involved a further problem caused from the fact that depending on the hardness of the soil material, the excavated ditch 17 may be steep or gentle in respect of its inclination and accordingly the ditch varies in width (the greater the pipe 18 becomes in diameter, this variation becomes the greater). As shown in FIG. 4, wherein a number of working positions assumed by the machine are illustrated, a width $W_1$ which is a maximum reach of the plate compactor 11 as indicated by K, is determinable solely by the type of machine in use. Accordingly, even when backfilling and compacting an excavated ditch 17 of the same depth is performed, there is the necessity of having several machines of different capacities e.g., with shorter booms 3 and arms 6 and longer booms and arms, available for selective use.

Further, even in case the excavated ditch 17 is of a constant width, it may possibly happen that as the operation proceeds from the layer A to the layer D toward the ground surface level, the plate compactor 11 can hardly make contact with the soil adjacent the machine body because of the boom 3 and arm 6 being excessively lengthy (in FIG. 4, j indicates a working position in which the plate compactor 11 is closest to the machine body). Therefore, the zone E adjacent the upper swing structure 2 is left intact or untreated (F shows a processible zone). Accordingly, this raises a further problem in that it is necessary to employ a different machine with shorter boom 3 and arm 6, or alternatively to move the machine body rearwardly or to the left as viewed in FIG. 4 prior to resumption of the operation.

Still further, the conventional vibratory plate compactor 11, as shown in FIG. 2, includes vibration damping and force transmitting rubber members 15 mounted between the support bracket 13 and the vibrating unit 14, three on each side, fore and aft, with their axes extending perpendicularly of the axes of the pins 9, 10.

When the working force is applied through the pin 10 of the link 33 as shown in FIG. 2(A), it is those members 15 situated on the right side, as viewed in the drawing, that largely resist this force, the left-hand rubber members escaping in the upward direction. Hence, the right-hand rubber members 15 deflect showing shearing and bending resistances in the vertical direction against the working force, and accordingly, the support bracket 13 is also lowered of its right-hand side toward the vibrating unit 14, so that the magnitude of the working force to be transmitted to the unit 14 as a compacting force is reduced while the compacting force tends to be exerted on the right-hand part of the compacting plate 16. This again raises the problem of difficulties in attainment of effective compaction. When, on the other hand, the boom cylinder 4 is contracted in an attempt to exert the working force upon the plate compactor 11 through the pin 9, the circumstance will be the same as that described above in that because of those rubber members 15 on the left side mainly resisting the working force, those left-hand members would deflect so that only a small magnitude of compacting force is exerted upon the compacting plate. Meanwhile, with the left side part of the compactor 11 being lowered preliminarily through the pin 9 by extending the arm cylinder 7, the working force is applied on the side of the pin 10 at the tip end of the link. Nevertheless, this will also result in a decrease in the working force transmitted to the vibrating unit 14 as a compacting force because of the right-hand rubber members being deflected.

Yet further, the vibratory compaction working machine involves another problem that follows.

When the distributor 30 is actuated to spread out soil 19 as shown in FIG. 3, such soil would be placed in the area between the periphery of the pipe 18 and the side wall of the excavated ditch 17, or somewhat closer to the periphery of the pipe 18. However, there usually is formed a vacant space X immediately below the pipe and a pile of soil as spreaded because the soil can not enter underneath the pipe 18 where load from the pipe 18 be essentially borne.

Accordingly, it is necessary to force a volume of soil into the vacant space X underneath the pipe 18 and level off the piled soil surfaces prior to carrying out the compaction work by means of the compacting plate 11. To this end, it has been common practice that with a compacting plate 16 in the form of a flat board, the compactor 11 is pivotally moved about the pin 9 in a snap action by contracting the cylinder 12, thereby forcing a volume of soil 19 into underneath the pipe 18 by the compacting plate 16 and then the volume of soil thus pushed in is compacted.

However, this operation by use of the flat compacting plate 16 proved unsatisfactory in that it is still difficult to push in the soil since that soil being pushed tends to be compacted earlier prior to being pushed in mainly because of the inclination of the plate 16 with respect to the horizontal surface being small.

An object of the invention is to provide a vibratory compaction working machine of the type which is capable of performing effective compaction in a simplified operating manner while being available for common use to excavated ditches of different widths, and which is capable of performing the same while maintaining the distance between the main structure of the machine and the excavated ditch unaltered even when the position to be compacted proceeds in sequence upwardly of the ditch.

Another object of the invention is to provide a vibratory compaction working machine of the type specified which is capable of applying sufficient thrust forces upon around the middle of a compacting plate of the vibratory plate compactor for performance of efficient compaction.

Still another object of the invention is to provide a vibratory compaction working machine of the type specified which is capable of instantly forcing a volume of soil into underneath a pipe to be laid under the ground and compacting the same soil.

SUMMARY OF THE INVENTION

According to one aspect of the invention, there is provided a vibratory compaction working machine comprising a lower travel structure and an upper swing structure mounted on the lower travel structure, with the upper swing structure having a boom mounted thereon for pivotal movement by a first hydraulic cylinder, and an arm mounted on said boom at a forward end thereof for pivotal movement by a second hydraulic cylinder. A vibratory plate compactor is mounted on the arm at a forward end thereof for pivotal movement by a third hydraulic cylinder. The said arm comprises an extension arm having a first arm element and a second arm element mounted for linear movement relative to the first arm element by with the a fourth hydraulic cylinder, first arm element being attached at the forward end of the boom for pivotal movement by the second hydraulic cylinder and the second arm element having vibratory plate compactor attached at the forward end thereof for pivotal movement by the said third hydraulic cylinder.

According to another aspect of the invention, there is provided a vibratory compaction working machine comprising a lower travel structure and an upper swing structure mounted on the lower travel structure, with the upper swing structure having a boom mounted thereon for pivotal movement by a first hydraulic cylinder, and an arm mounted on the boom at a forward end thereof for pivotal movement by a second hydraulic cylinder. A vibratory plate compactor is mounted on the arm at a forward end thereof for pivotal movement by a third hydraulic cylinder with the vibratory plate compactor including a vibrating unit, a support bracket connected to the forward end of the arm by pin means, and vibration damping and force transmitting elastic means disposed between the vibrating unit and the support bracket and connected thereto. The elastic means is disposed with the axes thereof oriented in the same direction as the axis of the pin means.

According to a further aspect of the invention, there is provided a vibratory compaction working machine comprising a lower travel structure and an upper swing structure mounted on the lower travel structure, with the upper swing structure having a boom mounted thereon for pivotal movement by a first hydraulic cylinder, an arm mounted on the boom at a forward end thereof for pivotal movement by a second hydraulic cylinder, and a vibratory plate compactor mounted on the arm at a forward end thereof for pivotal movement by a third hydraulic cylinder. The vibratory plate compactor includes a vibrating unit and a compacting plate removably attached to the vibrating unit, with the compacting plate having a compacting surface of V-shaped cross-section.

DESCRIPTION OF THE PREFERRED EMBODIMENTS

Figure 5:
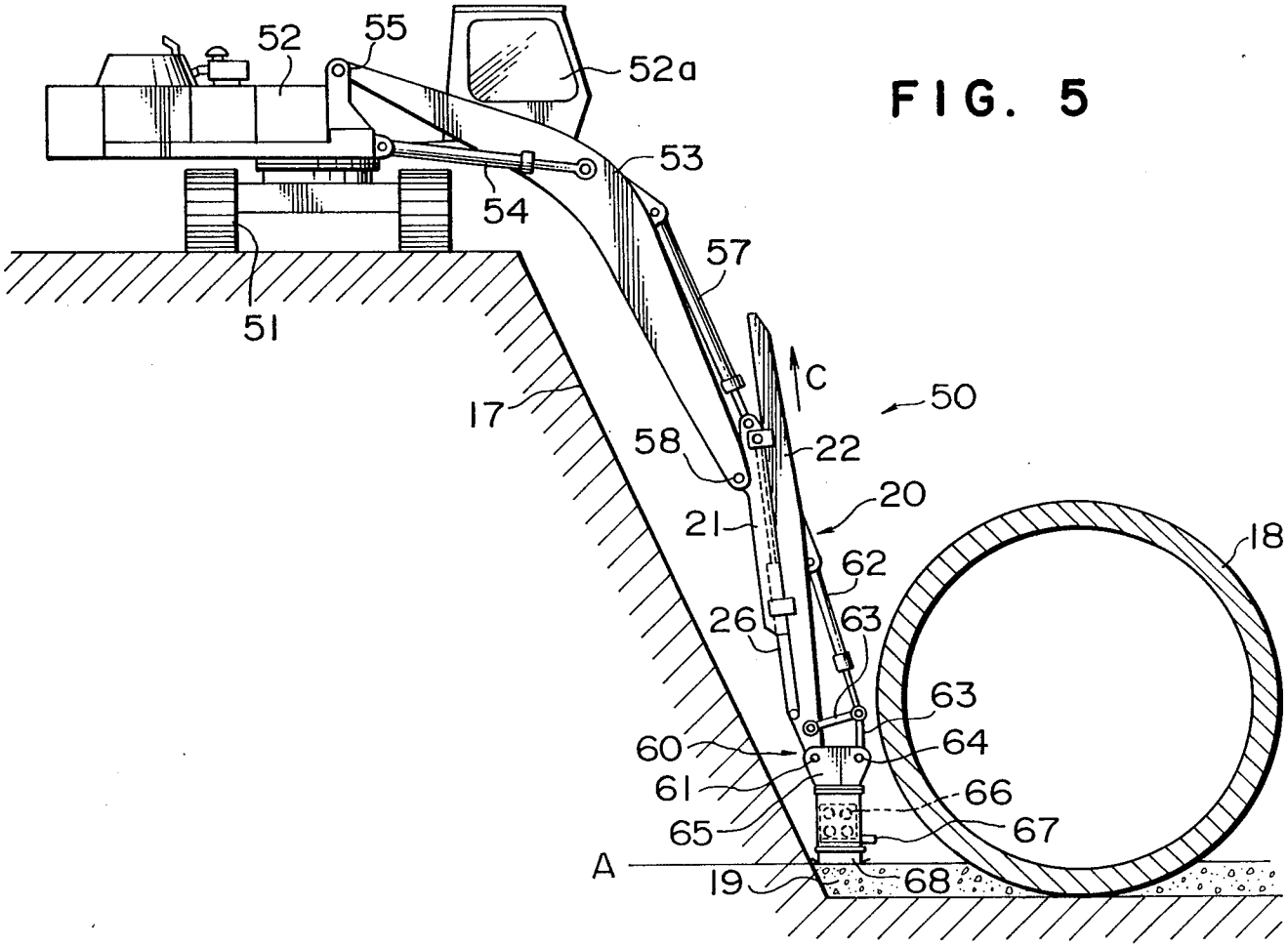
FIG. 5 is a side view showing a vibratory compaction working machine according to a first embodiment of the invention in its operating condition.

Referring now to the accompanying drawings wherein like reference numerals are used throughout the various views to designate like parts and, more particularly, to FIG. 5, according to this Figure a vibratory compaction working machine generally denoted by the reference numeral 50 employs a hydraulic excavator as a base machine. Thus, the machine 50 includes a lower travel structure 51 and an upper swing structure 52 mounted on the lower structure 51. The uppe swing structure 52, however, has a particular seat frame **52*a* modified to protrude more forwardly than the ordinary hydraulic excavator so as to enable an operator to command a view of the whole operating conditions. The uper swing structure 52 has a boom 53 mounted thereon for pivotal movement about a pin 55 by a hydraulic cylinder 54**.

The boom 53 is provided at its forward end with an extension arm 20, which, in turn, is provided at its forward end a vibratory plate compactor 60. The extension arm 20 includes a base arm 21 attached to the forward end of the boom 53 for pivotal movement about a further pin 58 by a further hydraulic cylinder 57, and a slide arm 22 attached for slidable movement relative to the base arm 21.

Figure 6:
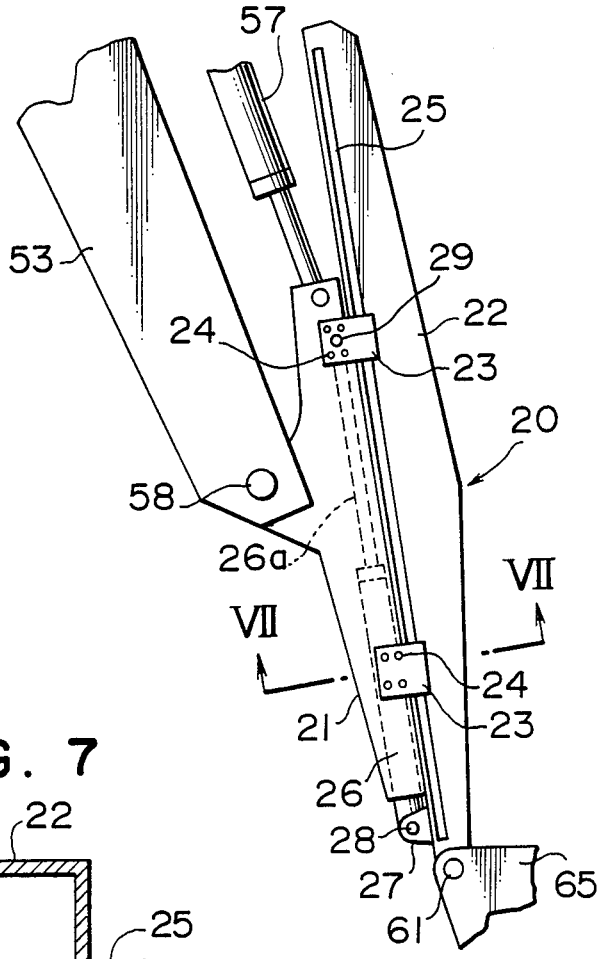
FIG. 6 is a side view showing a detail of the construction of an extension arm incorporated in the machine shown in FIG. 5.
Figure 7:
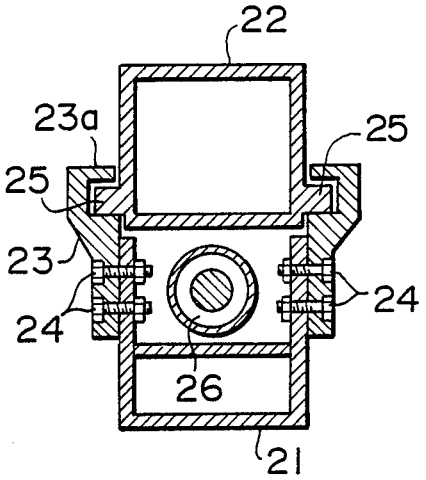
FIG. 7 is a cross-sectional view taken along the line VII—VII of FIG. 6.

As shown in FIGS. 6 and 7, in the extension arm 20, the base arm 21 is of U-shaped cross-section having opposed side portions on which guide members 23, each having a guide groove **23*a*, are mounted in front and in rear (or in the middle and in front, or over the entire length) thereof by bolts 24, and the slide arm 22 is of a rectangular shaped cross-section having opposed side rails each received in a corresponding one of the guide grooves 23*a*. A hydraulic arm extension cylinder 26 is connected at its head side end through a pin 28 to a bracket 27 provided on the lower side of the end of the slide arm 22, and is connected at its end of the side of a piston rod 26*a* to the rear end of the base arm 21 through another pin 29, so that the extension and contraction of the cylinder 26 can cause the slide arm 22 to move forward and backward along the base arm 21. The hydraulic cylinder 26 is disposed inwardly of the U-shaped base arm 21, and the slide arm 22 has its rear end positioned to protrude toward the side of the boom beyond the rear end of the base arm 21**.

The vibratory plate compactor 60 includes a support bracket 65 connected through a pin 61 to the forward end of the extension arm 20 i.e. the slide arm 22 while being connected through a linkage 63 and pin 64 to a hydraulic cylinder 62, a vibrating unit 67 connected to the bracket 65 through vibration damping and force transmitting rubber members 66, and a compacting plate 68 attached to the vibrating unit 67. The compacting plate 68 is detachably mounted on a fixing plate 35 of the vibrating unit 67 by means of fastening bolts 32 (See FIG. 8). The vibrating unit 67 includes hydraulic motor **67*a* and a pair of eccentric weights 67*b* driven by the motor 67*a*. The linkage 63, which provides for power amplification, is not necessarily required, and thus the piston rod of the hydraulic cylinder 62 may be connected directly to the support bracket 65 through the pin 64**.

For vibration damping and force transmitting the rubber members 66 are mounted with their axes oriented in the same direction as the axes of the pins 61, 64, with, for example, eight rubber members being eight in all, two upper and two lower members on each side.

The support bracket 65 of the vibratory plate compactor 60 includes an upper stationary frame **65*a* connected to the slide arm 22 and the linkage 63, a lower movable frame 65*b* rotatably connected to the upper stationary frame 65*a*, and a lock unit 78 provided between the two frames 65*a* and 65*b* for selectively restraining the lower movable frame 65*b* from rotating relative to the upper stationary frame 65*a***.

Figure 9:
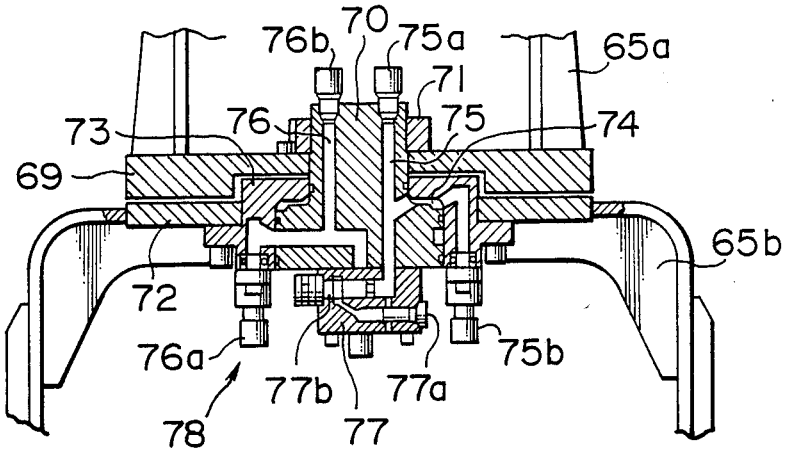
FIG. 9 is a sectional view showing a rotation lock unit incorporated in the vibratory plate compactor shown in FIG. 8.

As shown in FIG. 9, the upper stationary frame **65*a* has a stationary flange 69 attached to its bottom end, and a holder shaft 70 is fixed in the central portion of the flange 64 by a fastening nut 71. The lower movable frame 65*b* has a movable flange 72 attached to its top end. The lock unit 78 includes a lock piston 73 situated between the movable flange 72 and the holder shaft 70. This lock piston 73 is fixed to the movable flange 72 and is made sealingly rotatable relative to the holder shaft 70, with a hydraulic chamber 74 being defined between the lock piston 73 and the holder shaft 70. The movable flange 72 and lock piston 73 are dimensioned so that when a hydraulic fluid is not supplied to the chamber 74, a small clearance remains between them and the staionary flange 69, thereby permitting the lower movable frame 65*b* to rotate along with the lock piston 73 about the holder shaft 70 relative to the upper stationary frame 65*a***.

Within the holder shaft 70 and lock piston 73 are formed a pair of hydraulic passages 75, 76, with the hydraulic chamber 74 forming part of the hydraulic passage 75. The hydraulic passage 75 has an inlet port 75*a* leading to a hydraulic fluid source, not shown, and an outlet port 75*b* leading to the hydraulic motor 67*a*, while the oil passage 76 has an inlet port 76*a* leading to the hydraulic motor 67*a* and an outlet port 76*b* leading to a reservior, not shown. The holder shaft 70 is connected at its bottom a valve unit 77 including a check valve 77*a* and a relief valve 77*b*.

When the vibrating unit 67 is operated, a hydraulic fluid is supplied to the hydraulic motor 67*a* (See FIG. 8) through the passage 75, and returns therefrom through the passage 76 to the reservoir. When the hydraulic fluid flows through the passage 75, this fluid is also fed in the chamber 74 to thereby lift the lock piston 73 upwardly causing the movable flange 72 to engage the stationary flange 69. The lower movable frame 65*b* thus is locked from rotation relative to the upper stationary frame. In this manner, the lock unit 78 acts as an automatic lock operative in response to the operation of the vibrating unit 67. It is to be noted that the lock unit 78 alternatively may be of the remote control type operated independently of the vibrating unit 67.

The vibratory compaction working machine embodied according to the invention as described in the foregoing will now be described of its operation by reference back to FIG. 5.

When the first step of compacting the layer A has been completed, the extension cylinder 26 for arm 20 is operated to contract to some extent so as to slightly raise the slide arm 22 along the base arm 21 in the direction of C, however with the boom 53 being not operated. Subsequently, the machine travels a distance corresponding to the width W of the compacting plate 68 (See FIG. 8B), and then the extension cylinder 26 is operated to extend to lower the slide arm 22 along the base arm 21, so that the compacting plate 68 is caused to contact the layer surface, thereby attaining movement of the compacting position. In this operation, there is no risk of the cylinder 62, arm 20 or compactor 60 striking against the excavated ditch 17 or the pipe 18, and therefore it is secured to proceed with the shifting of the compacting position with ease and high efficiency. In the compacting operation after the machine once has moved a distance W, the process of applying a working force can be performed only by maintaining the compacting plate 68 in a horizontal posture and by extending the cylinder 26. The manipulation involved thus will be significantly simplified.

Figure 4:
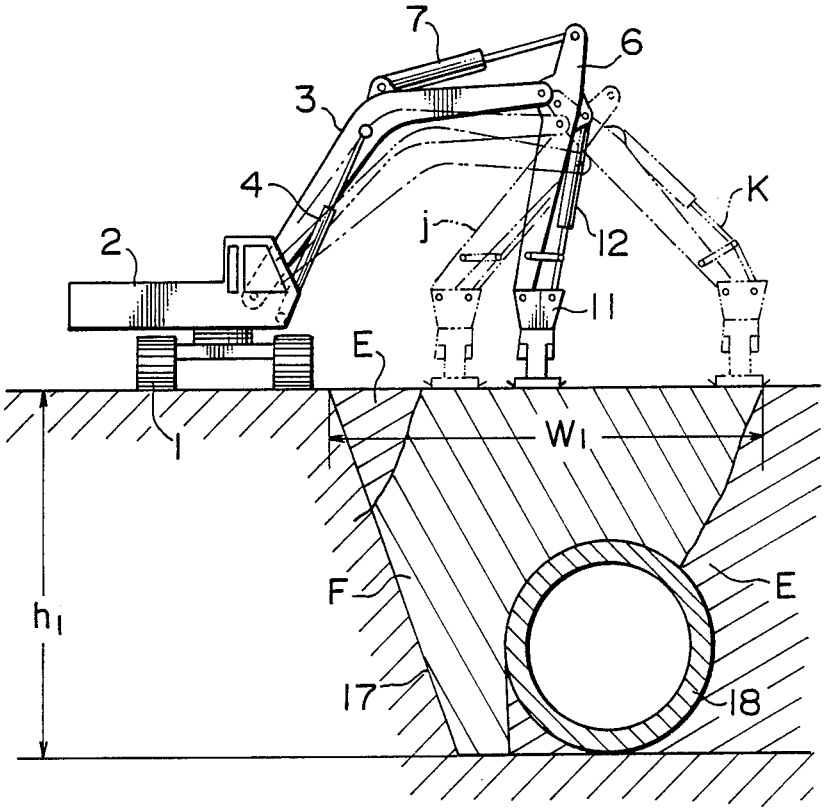
FIG. 4 PRIOR ART
FIG. 4 is a partly cut side view schematically showing the operating range of the prior art machine shown in FIG. 1.
Figure 10:
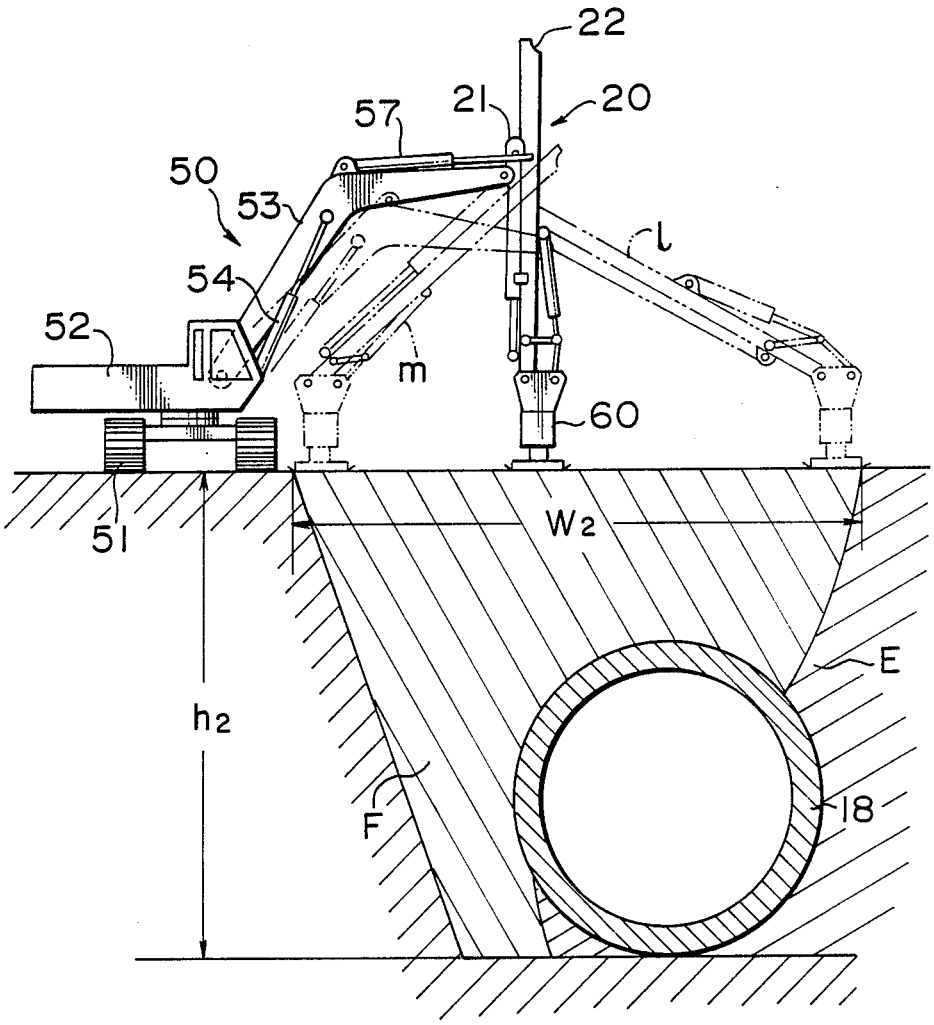
FIG. 10 is a partly cut side view schematically showing the operating range of the machine shown in FIG. 5.

Further, it can be appreciated that the extension of the arm 20 makes it possible to provide a depth $h_2$ of a compacted soil as shown in FIG. 10, much greater than the maximum height $h_1$ provided by the conventional machine shown in FIG. 4. Also, when it is desired to perform compaction either in a zone remote from the machine or adjacent the machine, the compactor 60 can be placed at a desired position as shown in FIG. 10 at l and m by extending of the arm 20. Thus, as compared with the operating range provided by the conventional machine as indicated at $W_1$ in FIG. 4, it is possible to provide a broader range of compaction operation as indicated at $W_2$ in FIG. 10. And further, it is possible to eliminate such zone adjacent the machine that cannot be compacted as indicated at E in FIG. 4. This provides for a broad range of compacting operation covering from a narrower ditch to a wider ditch or pipes 18 of varying diameters.

Still further, even if the surface level of soil layer being compacted is raised as the compacting operation proceeds, it is possible to place the compactor 60 at any desired position by extending and contracting the arm 20 while moving the machine adjacent the edge of the ditch 17, i.e., without the necessity of moving the machine far away from the ditch 17. This secures efficient operations and eliminates the necessity of replacement by another machine of the type having a shorter boom 3 and arm 6.

As mentioned with reference to FIG. 6, furthermore, the hydraulic cylinder 26 for moving the slide arm 22 is disposed within the base arm 21, and the rear end of the slide arm 22 is positioned to protrude toward the side of the boom 3 beyond the rear end of the base arm 21 when the slide arm 22 is in its most retracted position. This provides a prolonged length of stroke for the slide arm 22 i.e. the slide arm 20 such that the length in the retracted position is about a half of that in the extended position, thereby increasing the operating range.

Figure 8A:
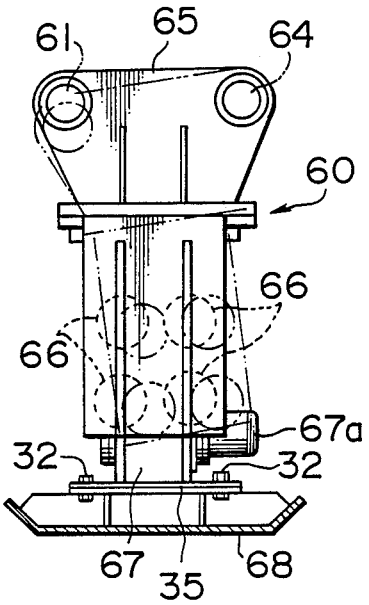
FIG. 8(A) and FIG. 8(B), respectively, show a side view and a front view of the vibratory plate compactor incorporated in the machine shown in FIG. 5.

In the illustrated embodiment, also, as shown in FIG. 8, the compactor 60 has the vibration damping and force transmitting rubber members 66 mounted with their axes oriented in the same direction as the axis of the pin 61 or 65. Accordingly, when a working force is applied from the side of the pin 61 for compacting operation by manipulating the extension cylinder 26 or boom cylinder 54, as shown by the dotted lines in FIG. 8(A), all the eight rubber members 66 serve to provide shearing and bending resistances in the vertical direction as well as shearing resistance in the horizontal direction, so that resistance forces of the rubber members 66 become greater. Consequently, a greater working force can be transmitted to the vibrating unit 67 before the left side portion of the support bracket 65, as viewed in FIG. 8(A), sinks as indicated by the dotted lines, and also an additional thrust can be transmitted through the right-hand rubber members 66, and this enables the resultant compacting force to be concentratedly exerted around the central portion of the compacting plate 68.

Figure 8B:
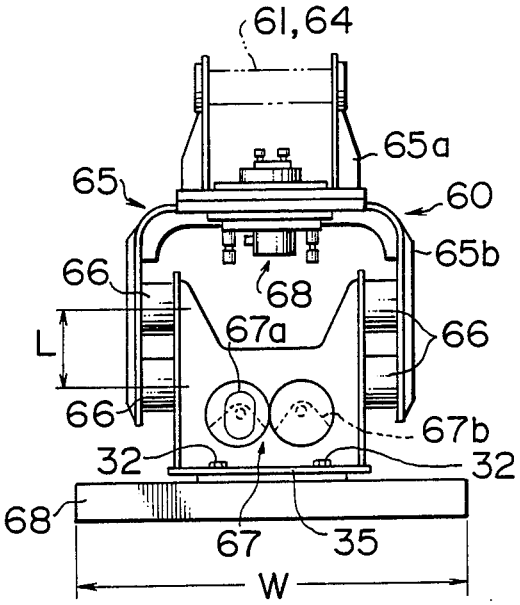

Also, if the working force is applied with the right-hand of the support bracket being sunk by extending the hydraulic cylinder 62, in anticipation of the sinking of the left-hand portion of the bracket shown in FIG. 8(A), then there can be provided a still greater working force to be transmitted to the compacting plate. Further, it is possible to further increase the resistance of the rubber members 66 against the working force applied from above by increasing the pitch L between the vertically aligned rubber members 66 as shown in FIG. 8(B). Thus, the efficient compacting operation can be performed.

In the embodiment illustrated, the support bracket 65 of the compactor 60 is divided into the upper stationary frame 65*a* and the lower movable frame 65*b* rotatable relative thereto, the lock unit 78 being provided therebetween for selectively restraining the two frames from relative rotational movement. With this construction, it will be appreciated that when the compactor 60 is brought into and out of the ditch 17 or when the compactor 60 is lifted after completion of the compaction and then the machine is moved to the next position where the compactor 60 is once again lowered into a set position, the lower portion of the compactor below the lower movable frame 65*b* is free to swing away from the pipe 18 or ditch 17 even if the compacting plate 68 of the compactor 60 should strike against the ditch 17 or pipe 18, thus avoiding the risks of the pipe 18 being damaged. Further, it is advantageously possible to adjust the compacting plate 68 maintained at all times parallel to the pipe 18, thus facilitating the compacting operation.

Figure 1:
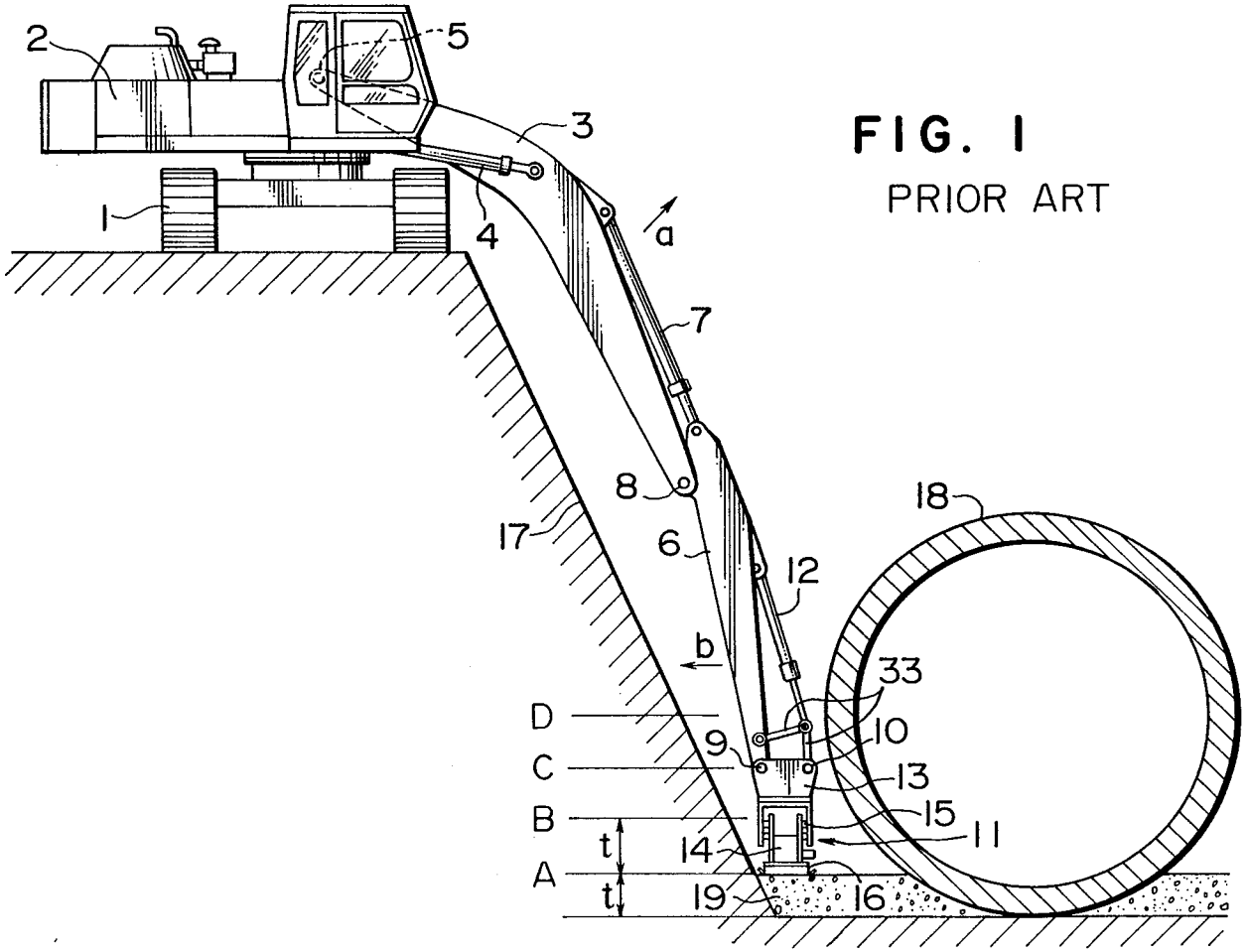
FIG. 1 PRIOR ART
FIG. 1 is a side view schematically showing a prior art vibratory compaction working machine in its operating condition.
Figure 2A:
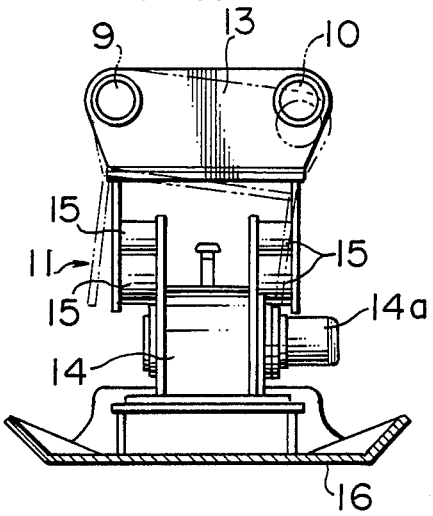
FIG. 2(A) PRIOR ART
FIG. 2(A) and FIG. 2(B), respectively, show a side view and a front view of a vibratory plate compactor incorporated in the prior art machine shown in FIG. 1.
Figure 2B:
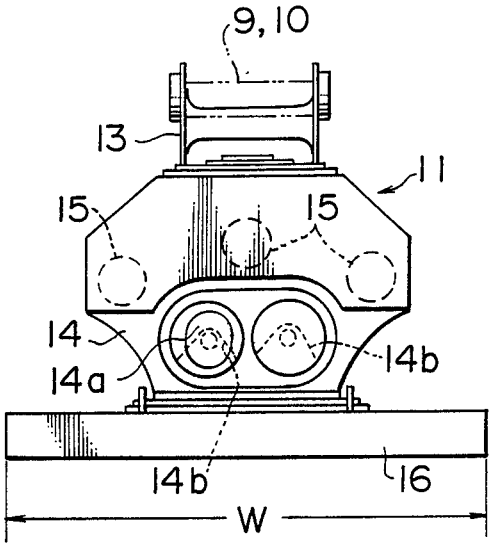
FIG. 2(B) PRIOR ART
Figure 3:
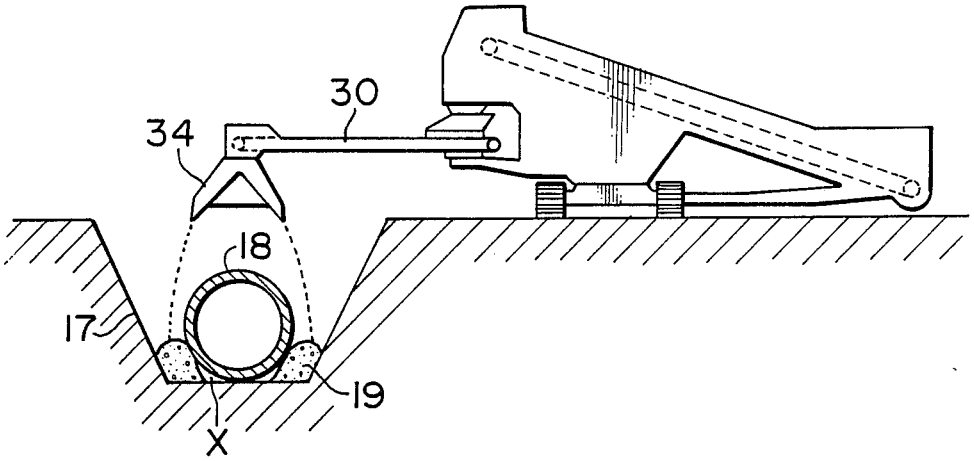
FIG. 3 is a side view schematically showing a soil distributor for backfilling in its operating condition.
Figure 11:
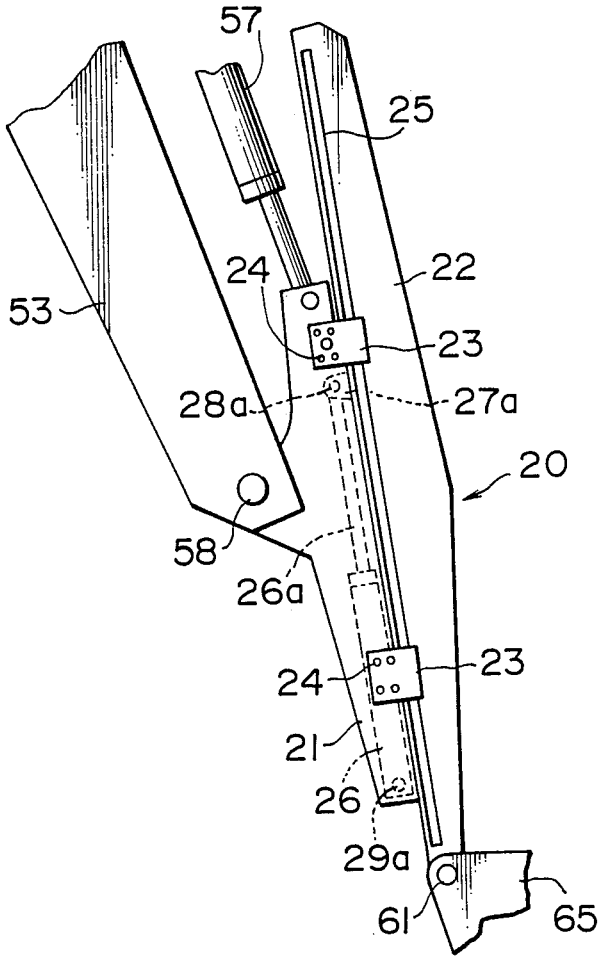
FIG. 11 is a side view showing an altered embodiment of the extension arm incorporated in the machine shown in FIG. 5.
Figure 12:
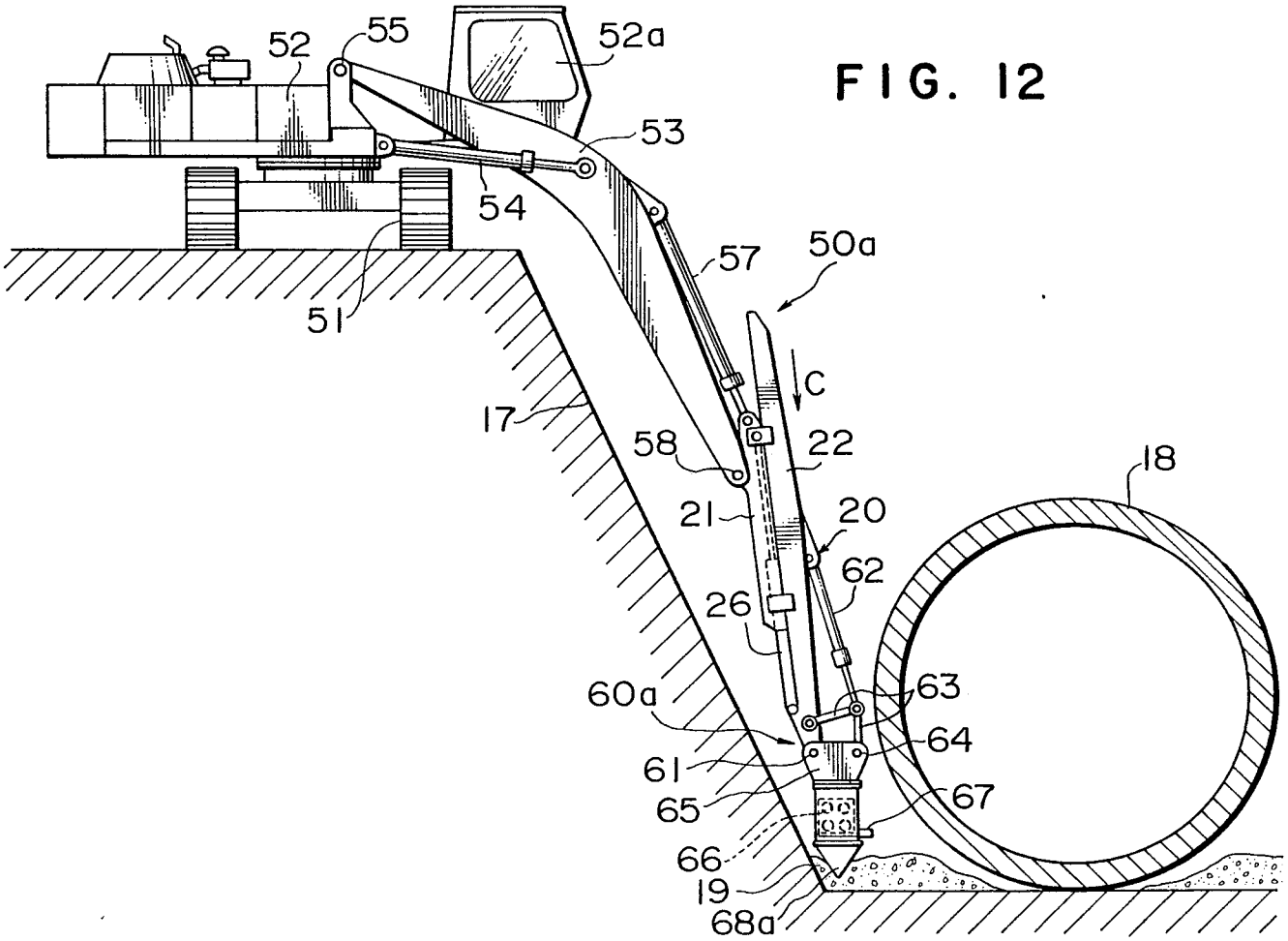
FIG. 12 is a side view showing a vibratory compaction working machine according to another embodiment of the invention in its operating condition.
Figure 13A:
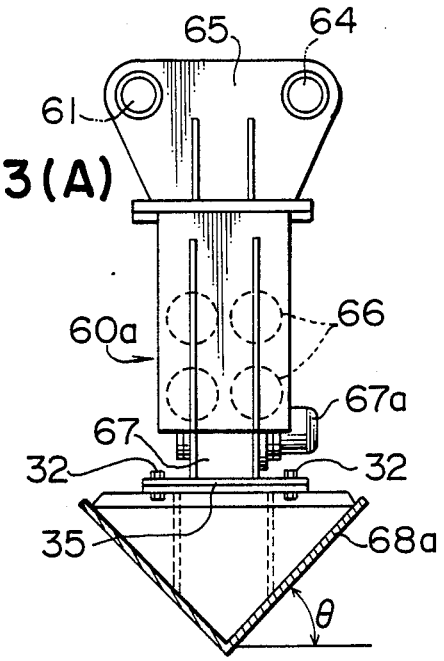
FIG. 13(A) and FIG. 13(B), respectively, show a side view and a front view of the vibratory plate compactor incorporated in the machine shown in FIG. 12.
Figure 13B:
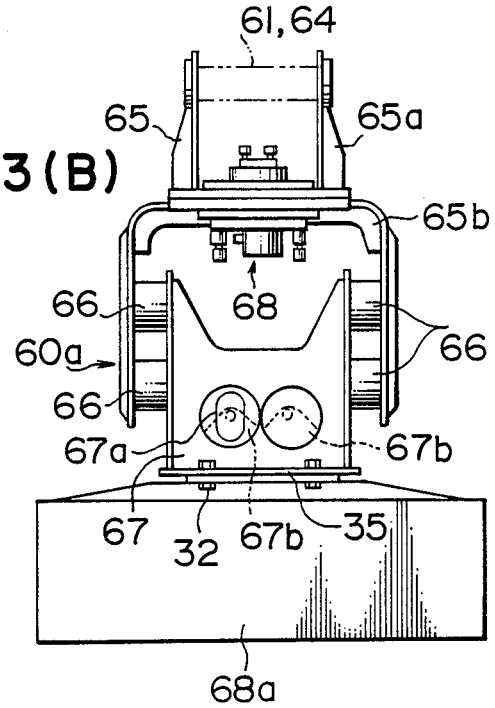

In the above-described embodiment, the mounting of the extension cylinder 26 in the extension arm 20 has been described as such that the head side of the cylinder is connected to the slide arm 22 and the piston rod **26*a* to the base arm 21. However, this may alternatively be such that, as shown in FIG. 11, the head side of the cylinder is connected through a pin 29*a* to the forward end of the base arm 21 and the end of the piston rod 26*a* is connected through a pin 28*a* to the bracket 27*a* provided at the lower side of the slide arm 22. With this alternative arrangement, the piping for the cylinder can advantageously be mounted with significant ease since the piping for the extension cylinder 26 is kept stationary while the cylinder 26 operates. Additionally, there is provided a further advantage that the cylinder rod 26*a* is not subjected to compressive forces when a working force is applied to the compactor 60 through the hydraulic cylinder 26. As shown in FIGS. 12 and 13, a vibratory compaction working machine 50*a* includes a vibratory plate compactor 60*a* with a vibrating unit 67 having a compacting plate 65*a* of V-shaped cross-section bolted at 32 to the mounting plate 35 in a detachable manner. This type of compactor is particularly adapted to use for forcing-in of soil under the pipe 18 and compacting thereof in the earlier stage of backfilling the excavated ditch 17. That is, as shown in FIG. 3, when the distributor 30 spread soil 19 around the bottom of the ditch 17, there usually occurs a vacant space X under the pipe 18 while the spread soil is mountain-shaped. Under these conditions, the cylinder 62 is contracted to swing the compactor 60*a* about the pin 61 in a snap action, so that the compacting plate 68*a* can force the spread soil 19 to be compacted into the vacant space X while leveling off the mountain-shaped soil. In this operation, as the compacting plate 68*a* has a V-shaped compacting surface, it is possible to make the forcing and compaction of soil underneath the pipe quite easily since the compacting surface forms a greater angle of inclination $\theta$ with respect to the horizontal surface, as shown in FIG. 13. Further, it will be appreciated that in the process of forcing soil in underneath the pipe and compacting it through the snap action of the compactor, there can advantageously be provided a unitary movement effected by both of the support bracket 65 and the V-shaped compacting plate 68*a* due to the featured arrangement that the elastic means 66 of the compactor 60*a* are directed parallel to the axis of the pin 61** and are mounted vertically in two stages as upper and lower rubber members.

Upon completion of this operation, the compacting plate **68*a* is removed and the ordinary compacting plate 68 described in the previous embodiment is attached to the compactor to thereby allow the ordinary compacting operation to be performed in a manner explained previously. Such operations are continued until there will be no vacant space underneath the pipe when soil is distributed into the ditch 17**.

In the above-described embodiment, the extension arm 20 is constructed so that it comprises the base arm 21 and the slide arm 22 mounted on the upper sides of the base arms 21 for slidable movement therealong by means of the hydraulic cylinder 26. This, however, may be embodied otherwise, provided that the slide or extension arm 20 essentially comprises a first arm element and a second arm element mounted for linear movement relative to each other by means of a hydraulic cylinder. Nevertheless, the slide or extension arm 20 of the type above-described as having the base arm 21 and the slide arm 22 is duly considered to be most preferred since it attains not only fundamental advantageous effect to satisfy the object of the invention, but also the oter unique advantages as follows.

Since the slide arm 22 is mounted on the upper surface of the base arm 21 for slidable movement therealong, the base arm 21 need only be long enough to mount the paired guides 23 and thus may be substantially shorter than the slide arm in length, while the slide arm may have any desired shape or length suited to provide a necessary strength. Accordingly, as compared with an extension arm of the telescopic type, for instance, in which two tubular arm elements are telescopically extensible relative to each other, the present construction ensures cutdown in weight, reduction of the manufacturing cost and improvement on the operating stability.

Additionally since the slide arm 22 is supported for slidable movement by a pair of guides 23 attached on the base arm 21, the distance between the fulcrums for support of the slide arm 22 (a distance between the guides 23) remains constant no matter how the slide arm 22 is extended. Therefore, as compared with the above guoted telescopic type extension arm in which as the lower arm element is extended, the distance between the fulcrums on the upper arm element becomes small, the present construction will provide consistent stability secured through the entire compacting operation.

Furthermore, since the base arm 21 can be substantially shortened more than the slide arm 22 as mentioned in the above a, the extension arm can be shortened accordingly when it is in the most retracted position. Therefore, as compared with the above quoted telescopic type extension arm in which the length of the arm in a most retracted position is determined by the length of the one of the two tubular arm elements that has a longer length, the present construction offers a superior workability in that the machine can cover a wide range of performance from the bottom to the top of the ditch and from a greater width to a smaller width of the ditch.

Moreover, as shown in FIGS. 6 and 7, the guide groove **23*a*, the slide surfaces of the side rails 25 and the hydraulic cylinder 26** for extension of the arm are exposed outwardly or disposed to permit easy access by the operator. Thus, as compared with the above quoted telescopic type extension arm in which the slide surfaces and the extension cylinder are consealed within the tubular arms, the present construction provides easy maintenance to the slide surfaces and cylinder.

Figure 14:
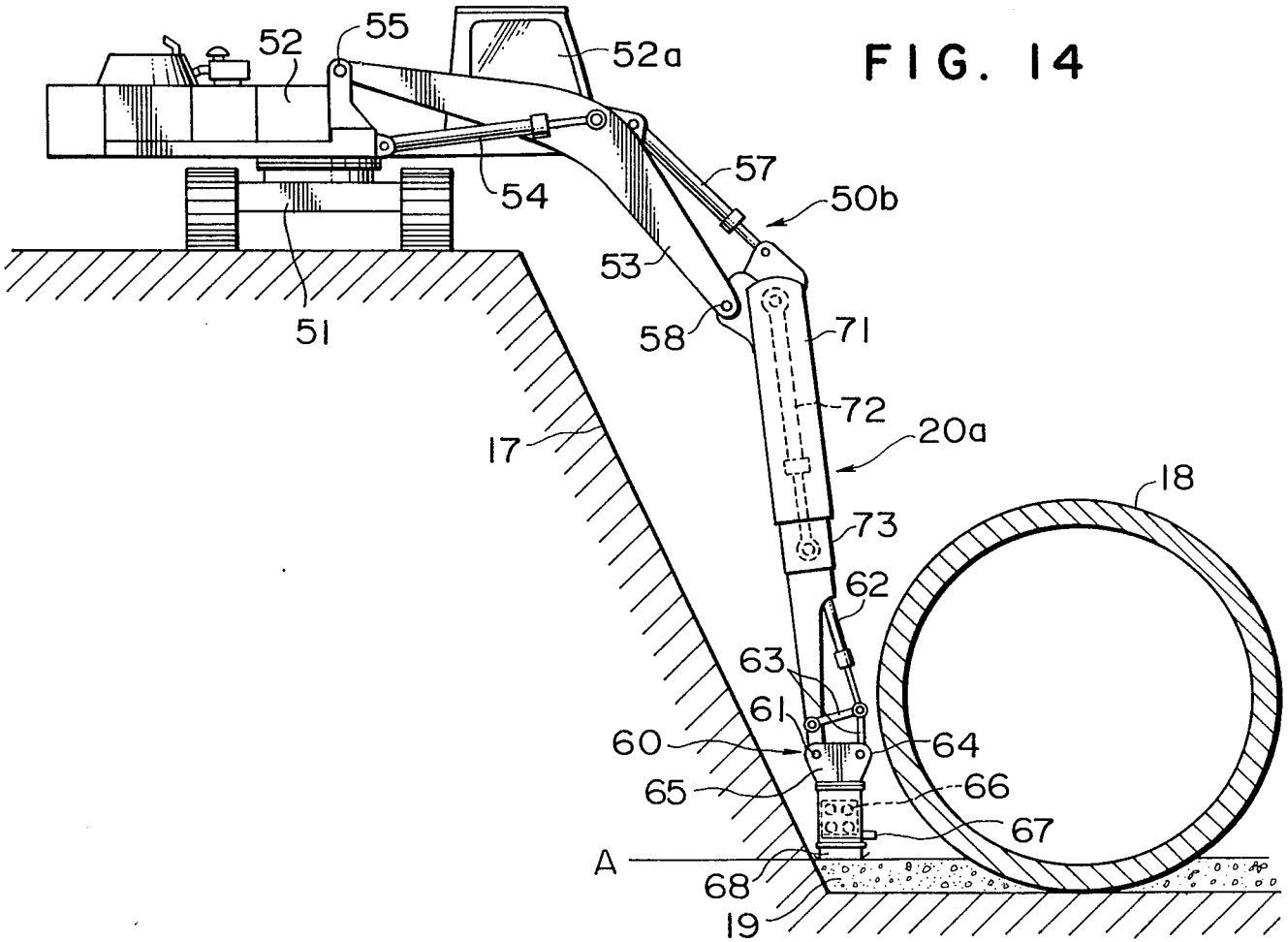
FIG. 14 is a side view schematically showing a vibratory compaction working machine according to still another embodiment of the invention.

In FIG. 14, a vibratory compaction working machine **50*b* has an extension arm 20*a* of the telescopic type including an outer tubular arm 71 which is mounted for pivotal movement about the pin 58 by the hydraulic cylinder 57, and an inner tubular arm 73 mounted inside the outer tubular arm 71 for telescopically sliding movement therealong by means of another hydraulic cylinder 72**.

It will be easily understood that as with the earlier described embodiments, the extension arm **21*a* thus constructed is capable of performing a compacting operation with ease simply by manipulating the hydraulic cylinder 72 and covering a wide range of operation by the manipulation of the arm 20***a*.

As having described above, the vibratory compacting working machine according to the invention has an extension arm mounted for pivotal movement on the forward end of the boom pivotally attached on the upper swing structure, the compactor being pivotally mounted on the forward end of the extension arm. With this construction, therefore, the invention is capable of lineally raising and lowering the compactor between the ditch wall and the embedded pipe through rather simplified manupulation of extending and contracting the extension arm in contrast to the conventional complicated combined operation of the boom and arm. The operation of compaction thus can be carried out effectively yet without any risk of the moving parts such as hydraulic cylinder, arm or compactor striking against the ditch wall or the pipe. The operator of the machine can raise or lower the compactor with simple manipulation, and therefore reduce the labor involved and enabling operation of the machinery by unskilled operators.

In addition, according to the invention, the extension of the extension arm makes it possible to practice the compacting operation for the depth of the ditch far greater than the maximum depth attainable by the conventional machine. In case, further, the compacting operation is conducted for the area adjacent the machine body or remote therefrom, the extension of the extension arm also makes it possible to reach the compactor to the respective desired positions, thereby enabling the operation effected over a range broader than before. And yet, since there will be eliminated any zone adjacent the machine where the compacting operation is impracticable, the use of a single machine is enough to practice the compacting operation against a variety of ditch from narrow to broad or laid pipes of various diameters. There is no necessity to use a plurality of machines having booms and arms of different lengths, so that the operation wil be economized by the application of the invention.

Further, even when the surface level of soil being compacted is elevated as the operation proceeds, it is possible, by the manipulation of the extension arm, to set the compactor at any desired place without moving the machine from the excavated ditch. This operation is quite efficient and again does not need any substitution by a machine of the type having shorter booms and arms.

Still further, according to the invention, between the support bracket of the compactor connected through pin to the slide arm and the vibrating unit of the compactor are provided vibration damping and force transmitting rubber members with their axes directed parallel to the axis of the above pin. With this arrangement, therefore, when a working force is applied through the pin for compacting operation, there occur vertically directed shearing and bending resistances, as well as horizontally directed shearing resistance in the rubber members, resulting in an increase in the total resisting force, and therefore it is possible to transmit a greater compacting force that acts concentratedly upon the central portion of the compacting plate. The invention thus can assure highly efficient operation of compaction.

Yet further, according to the invention, the compactor attached at the forward end of the arm releasably attaches a compacting plate with a compacting surface of V-shaped cross-section. This arrangement facilitates the forcing-in and compacting of soil underneath the pipe by virtue of a greater inclination angle of the compacting surface relative to the horizontal surface.

What is claimed is:

1. A vibratory compaction working machine comprising a lower travel structure and an upper swing structure mounted on the lower travel structure, said upper swing structure having a boom mounted thereon for pivotal movement by a first hydraulic cylinder, an arm mounted on said boom at a forward end thereof for pivotal movement by a second hydraulic cylinder, and a vibratory plate compactor mounted on said arm at a forward end thereof for pivotal movement by a third hydraulic cylinder; wherein said arm comprises an extension arm having a first arm element, a second arm element, and guide means for enabling a linear movement of the second arm element relative to the first arm element, said first arm element being attached at the forward end of said boom for pivotal movement by said second hydraulic cylinder and said second arm element having said vibratory plate compactor attached at the forward end thereof for pivotal movement by said third hydraulic cylinder, wherein said first arm element comprises a base arm and said second element comprises a slide arm, and wherein said guide means includes groove means provided on one of said base arm and slide arm and slide means provided on the other of said base arm and slide arm and slidably received in said groove means for slidable movement of said slide arm along the upper side of said base arm.

2. A vibratory compaction working machine according to claim 1, wherein said slide arm has a length longer than said base arm and said groove means and slide means are adapted to position a rear end of said slide arm so as to protrude toward the side of said boom beyond a rear end of said base arm when said slide arm is in its most retracted position.

3. A vibratory compaction working machine according to claim 1, wherein said vibratory plate compactor includes a vibrating unit and a compacting plate removable attached to said vibrating unit, said compacting plate having a compacting surface of a substantially V-shaped cross-section with an apex.

4. A vibratory compaction working machine according to claim 1, wherein said extension arm further includes a fourth hydraulic cylinder disposed within an inner space of said base arm for movement of said slide arm relative to said base arm, said fourth hydraulic cylinder having a head side end thereof fixed at one end of the forward end of said base arm and said slide arm and a rod side end thereof fixed to the other of said forward end of said base arm and said slide arm.

5. A vibratory compaction working machine comprising a lower travel structure and an upper swing structure mounted on the lower travel structure, said upper swing structure having a boom mounted thereon for pivotal movement by a first hydraulic cylinder, an arm mounted on said boom at a forward end thereof for pivotal movement by a second hydraulic cylinder, and a vibratory plate compactor mounted on said arm at a forward end thereof for pivotal movement by a third hydraulic cylinder; wherein said arm comprises an extension arm having a first arm element, a second arm element mounted for linear movement relative to said first arm element by means of a fourth hydraulic cylinder, said first arm element being attached at the forward end of said boom for pivotal movement by said second hydraulic cylinder and said second arm element having said vibratory plate compactor attached at the forward end thereof for pivotal movement by said third hydraulic cylinder, and wherein said vibratory plate compactor includes a vibrating unit, a support bracket connected to the forward ends of said second arm element by pin means, and vibration damping and force transmitting elastic means disposed between said vibrating unit and said support bracket and connected thereto, said elastic means being disposed with the axes thereof oriented in the same direction as the axis of said pin means.

6. A vibratory compaction working machine according to claim 5, wherein said fourth hydraulic cylinder has a head side end thereof fixed at the forward end of said base arm and a rod side end thereof fixed to said slide arm.

7. A vibratory compaction working machine comprising a lower travel structure and an upper swing structure mounted on the lower travel structure, said upper swing structure having a boom mounted thereon for pivotal movement by a first hydraulic cylinder, an arm mounted on said boom at a forward end thereof for pivotal movement by a second hydraulic cylinder, and a vibratory plate compactor mounted on said arm at a forward end thereof for pivotal movement by a third hydraulic cylinder; wherein said arm comprises an extension arm having a first arm element, a second arm element mounted for linear movement relative to said first arm element by means of a fourth hydraulic cylinder, said first arm element being attached at the forward end of said boom for pivotal movement by said second hydraulic cylinder and said second arm element having said vibratory plate compactor attached at the forward end thereof for pivotal movement by said third hydraulic cylinder, and wherein said vibrator plate compactor includes a support bracket connected to a vibrating unit through vibration damping and force transmitting elastic means, said support bracket having an upper stationary frame connected to said second arm element, a lower movable frame rotatably connected to said upper stationary frame and carrying said vibrating unit through said elastic means, and lock means disposed between said upper stationary frame and said lower movable frame for selectively restraining the lower movable frame for selectively restraining the lower movable frame from rotating relative to the upper stationary frame.

8. A vibratory compaction working machine according to claim 7, wherein said lock means includes a hydraulically operated lock piston and said vibrating unit includes eccentric weights rotatingly driven by a hydraulic motor, said lock piston being operative in response to the operation of said hydraulic motor to provide an automatic lock.

9. A vibratory compaction working machine comprising a lower travel structure and an upper swing structure mounted on the lower travel structure, said upper swing structure having a boom mounted thereon for pivotal movement by means of a first hydraulic cylinder, an arm mounted on said boom at a forward end thereof for pivotal movement by means of a second hydraulic cylinder, a vibratory plate compactor mounted on said arm at a forward end thereof for pivotal movement by means of a third hydraulic cylinder; wherein said vibratory plate compactor includes a vibrating unit, a support bracket connected to the forward end of said arm by pin means, and vibration damping and force transmitting elastic means disposed between said vibrating unit and said support bracket and connected thereto, said elastic means being disposed with the axes thereof oriented in the same direction as the axis of said pin means.

10. A vibratory compaction working machine according to claim 9, wherein said elastic means comprises rubber members each having an axis oriented in the same direction as the axis of said pin means and mounted vertically in two stages with one above another.

11. A vibratory compaction working machine according to claim 9, wherein said rubber members are disposed with their axes oriented in a direction prependicular to an axis of a hydraulic motor of said vibrating unit.

* * * * *